US010708681B1

(12) United States Patent
Williams

(10) Patent No.: US 10,708,681 B1
(45) Date of Patent: Jul. 7, 2020

(54) REPLACEMENT CABLE AND AUXILIARY AUDIO SYSTEM FOR IN-EAR MONITORS

(71) Applicant: Zachary Williams, Hermitage, TN (US)

(72) Inventor: Zachary Williams, Hermitage, TN (US)

( * ) Notice: Subject to any disclaimer, the term of this patent is extended or adjusted under 35 U.S.C. 154(b) by 0 days.

(21) Appl. No.: 16/266,269

(22) Filed: Feb. 4, 2019

Related U.S. Application Data

(60) Provisional application No. 62/627,023, filed on Feb. 6, 2018.

(51) Int. Cl.

| | |
|---|---|
| ***H04R 1/10*** | (2006.01) |
| ***H04R 29/00*** | (2006.01) |
| ***H04R 3/00*** | (2006.01) |
| ***H04R 1/40*** | (2006.01) |

(52) U.S. Cl.
CPC ..... *H04R 1/1041* (2013.01); *H04R 1/1016* (2013.01); *H04R 1/1033* (2013.01); *H04R 1/1083* (2013.01); *H04R 1/406* (2013.01); *H04R 3/005* (2013.01)

(58) Field of Classification Search
CPC ... H04R 2225/55; H04R 25/652; H04R 3/005
USPC ..... 381/56, 58, 74, 119
See application file for complete search history.

(56) References Cited

U.S. PATENT DOCUMENTS

| | | | |
|---|---|---|---|
| 7,231,233 | B2 | 6/2007 | Gosieski, Jr. |
| 8,160,261 | B2 | 4/2012 | Schulein et al. |
| 2005/0113136 | A1 | 5/2005 | Gosieski, Jr. |
| 2005/0281423 | A1 | 12/2005 | Armstrong et al. |
| 2010/0329491 | A1 | 12/2010 | Johansen |
| 2011/0096934 | A1 | 4/2011 | Babarskas et al. |

*Primary Examiner* — George C Monikang
(74) *Attorney, Agent, or Firm* — Patterson Intellectual Property Law, P.C.; Ryan D. Levy; Gary L. Montle

(57) ABSTRACT

A cable apparatus, and systems and methods, are provided for mixing ambient sound signals generated by the cable apparatus with a monitor mix signal received by the cable apparatus for transmission to first and second in-ear monitoring devices. The cable apparatus may be connected between an audio signal transceiver and the first and second in-ear monitoring devices of an audio monitoring system. The cable apparatus comprises an electrical communications channel that includes first and second connectors for coupling with the first and second in-ear monitoring devices and a third connector for coupling with the audio signal transceiver. The cable apparatus is configured to generate first and second ambient sound signals associated with first and second microphones coupled along the electrical communications channel of the cable apparatus proximate to the first and second connectors. The cable apparatus actively mixes the first and second ambient sound signals with the monitor mix signal.

20 Claims, 7 Drawing Sheets

REPLACEMENT CABLE AND AUXILIARY AUDIO SYSTEM FOR IN-EAR MONITORS

CROSS-REFERENCES TO RELATED APPLICATIONS

This application claims benefit of U.S. Provisional Patent Application No. 62/627,023, filed Feb. 6, 2018 and entitled "Replacement Cable and Auxiliary Audio System for In-Ear Monitors," and the subject matter for which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present invention relates generally to in-ear sound monitoring. More particularly, this invention pertains to audio mixing of ambient noise with a monitor mix signal.

BACKGROUND

Musicians playing a live concert need to hear themselves and the band. It has long been known for audio engineers to combine multiple audio inputs and generate a primary mix and/or one or more customized audio mixes for transmission to respective musicians during a performance. Sometimes a floor wedge speaker may be implemented, for example for users to hear their customized mix of the music, and other times they use custom headphones that are molded to fit their ear canal. Such headphones and their equivalents are conventionally known in the industry and referred to herein as "in-ear monitors." The headphone portion that go inside the ear canal are referred to as "molds". In-ear monitors also typically are paired with a wireless audio receiver which may be referred to herein as a body pack. A conventional body pack also has a volume control on it which enables the user to manually adjust his/her master volume. Because of the configuration of the aforementioned in-ear monitors, including their composition and the way they are shaped to fit into the ear canal, in-ear monitors are capable of blocking a large portion of the external sound, so that substantially all ambient noise is blocked and the listener only hears the band's monitor mix at a much lower volume, and whereby the potential long-term impact on the listener's hearing is substantially reduced.

The most common problem with using in-ear monitors is the listener may feel too "isolated," frequently complaining that the sound is a bit "unnatural" because the accustomed room noise or ambience is no longer present. If the musician can no longer hear if the crowd is involved, this can be quite undesirable. One known solution is to position a plurality of microphones at the front of the stage, for example facing the crowd, and mix the ambient crowd noise back into the in-ear mix. This solution is still not ideal, at least because of the unnatural nature of the resulting sound—the musician's ears are not where the microphones are, and the microphones are stationary, so they do not move with the musician.

Another known, albeit transitory, solution implemented by musicians who use in-ear monitors is to, between or during songs, take one in-ear monitor out of their ear so they can hear the crowd and stage noise around them. At this point it becomes necessary to turn up the volume on their wireless body pack receiver to hear better with just one headphone in. This then results in potential damage to the musician's hearing over time, thereby defeating one of the purposes of using in-ear monitors in the first place (i.e., saving your hearing).

BRIEF SUMMARY

As previously noted, conventional in-ear monitors have replaceable cables, so an exemplary solution provided by an audio monitoring system as disclosed herein to the isolation problem caused by audio blocking headphones is to create a novel replacement cable assembly containing two micro-electrical-mechanical (MEMS) microphones attached near the ears of a user (e.g., one microphone near the left ear, and one microphone near the right ear), so the user can blend-in as much or as little room ambience back into the previously existing in-ear monitor mix without removing his/her headphones or needing to use crowd-facing microphones.

In an embodiment, a cable apparatus for connecting an audio signal transceiver to first and second in-ear monitoring devices is provided. The cable apparatus comprises an electrical communications channel, first and second microphones, an audio signal mixing circuit, and a controller. The electrical communications channel includes both of first and second connectors configured to selectively couple to the first and second in-ear monitoring devices, respectively. The first and second microphones are coupled along the electrical communications channel. The audio signal mixing circuit is coupled along the electrical communications channel and includes a switching device. The controller is configured to determine a power source input status of the audio signal mixing circuit. The controller is further configured to regulate the switching device responsive to a first power source input status to cause mixed audio signals from the first and second microphones and from the audio signal transceiver to be delivered to the first and second in-ear monitoring devices, and to regulate the switching device responsive to a second power source input status to cause only audio signals from the audio signal transceiver to be delivered to the first and second in-ear monitoring devices.

In another exemplary embodiment of the cable apparatus as disclosed herein, the electrical communications channel includes a third connector for selectively coupling to the audio signal transceiver. The third connector may for example be positioned opposite of the first and second connectors.

In another exemplary embodiment of the cable apparatus as disclosed herein, the audio signal mixing circuit and the controller are positioned nearer to the third connector than to the first and second connectors. Alternatively, the first and second microphones may for example be coupled nearer to the first and second connectors, respectively, than to the third connector.

In another exemplary embodiment of the cable apparatus as disclosed herein, the first and second microphones are offset from the first and second connectors, respectively, by an offset distance. The offset distance may be less than or equal to 5 inches.

In another exemplary embodiment of the cable apparatus as disclosed herein, the electrical communications channel is hard-wired to the audio signal transceiver.

In another exemplary embodiment of the cable apparatus as disclosed herein, a microphone adjustment interface is coupled to the audio signal mixing circuit. The microphone adjustment interface is configured for selectively adjusting the audio signals associated with the first and second microphones.

In another exemplary embodiment of the cable apparatus as disclosed herein, the microphone adjustment interface is also configured for selecting an operational mode of the cable apparatus. The operational mode may be at least one of an on mode, an off mode, a manual mode, a preset EQ mode, or a mute mode In another exemplary embodiment of the cable apparatus as disclosed herein, the microphone adjustment interface is an incremental rotary encoder.

In another exemplary embodiment of the cable apparatus as disclosed herein, both the first and second power source input statuses are associated with the audio signals from the audio signal transceiver passing through the cable apparatus according to a unity gain.

In another exemplary embodiment of the cable apparatus as disclosed herein, a battery is provided for at least powering the audio signal mixing circuit to enable active mixing of the audio signals of the audio signal transceiver and the first and second microphones by the audio signal mixing circuit.

In another exemplary embodiment of the cable apparatus as disclosed herein, the first power source input status is associated with power availability from a battery connected to the audio mixing circuit and the second power source input status is associated with power unavailability from the battery to the audio mixing circuit.

In another exemplary embodiment of the cable apparatus as disclosed herein, the second power source input status is associated with a component fault status such as an amp of the audio mixing circuit overheating.

In another exemplary embodiment of the cable apparatus as disclosed herein, the audio signal mixing circuit includes a digital signal processor for limiting and equalizing audio signals associated with the first and second microphones.

In another exemplary embodiment of the cable apparatus as disclosed herein, a timer is coupled to the controller. The timer is responsive to an absence of the audio signals from the audio signal transceiver for a predetermined time period to cause the controller to switch from the first power source input status to the second power input status.

DETAILED DESCRIPTION

Figure 1:
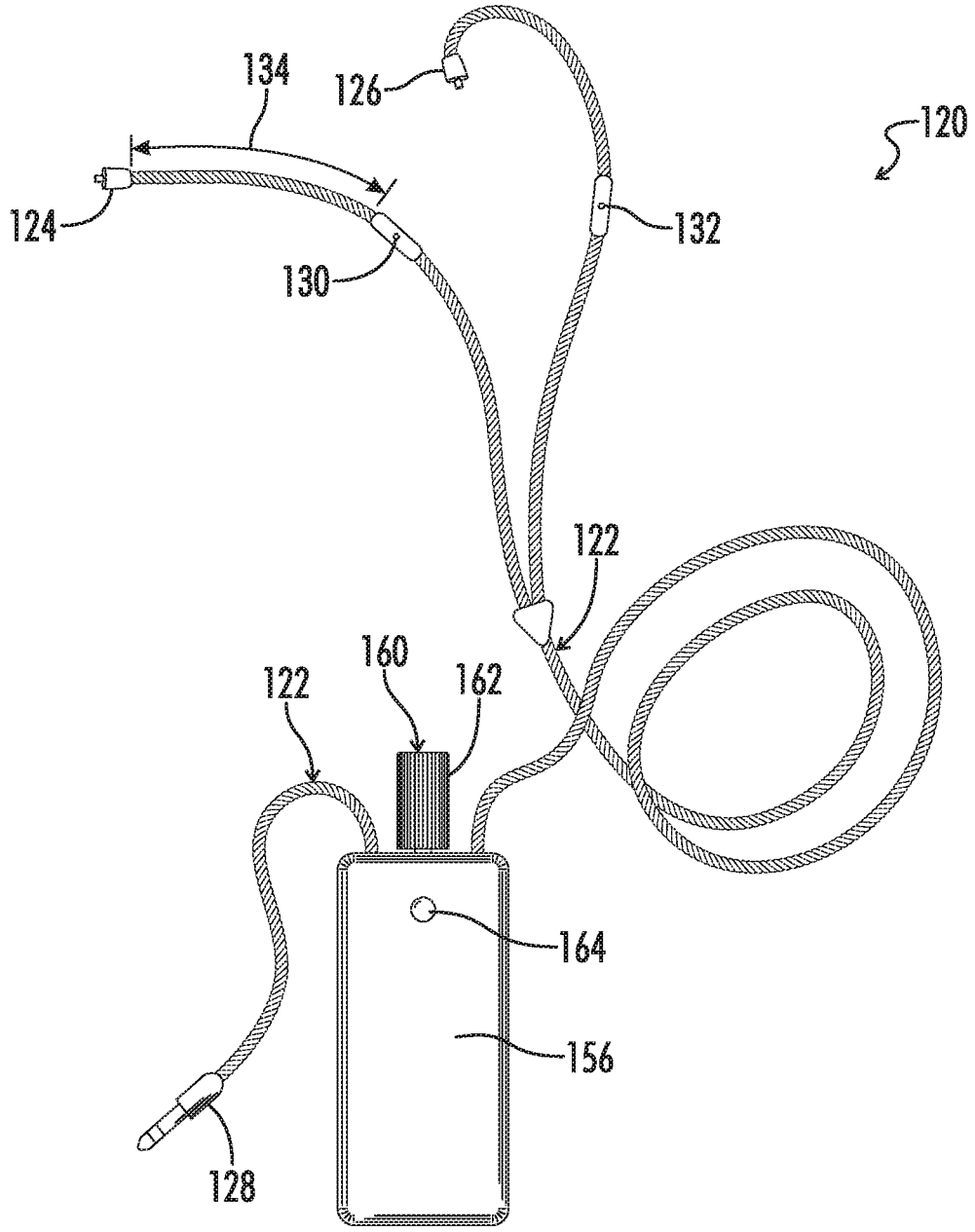
FIG. 1 illustrates a perspective view of an exemplary embodiment of a cable apparatus in accordance with the present disclosure.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-5, various exemplary embodiments of an audio monitoring system 100, a cable apparatus 120, and associated methods thereof may now be described in greater detail. The cable apparatus 120 may also be referred to herein as a cable device 120, a cable assembly 120, or an audio monitoring cable device 120. Where the various figures may describe embodiments sharing various common elements and features with other embodiments, similar elements and features are given the same reference numerals and redundant description thereof may be omitted below.

Figure 2:
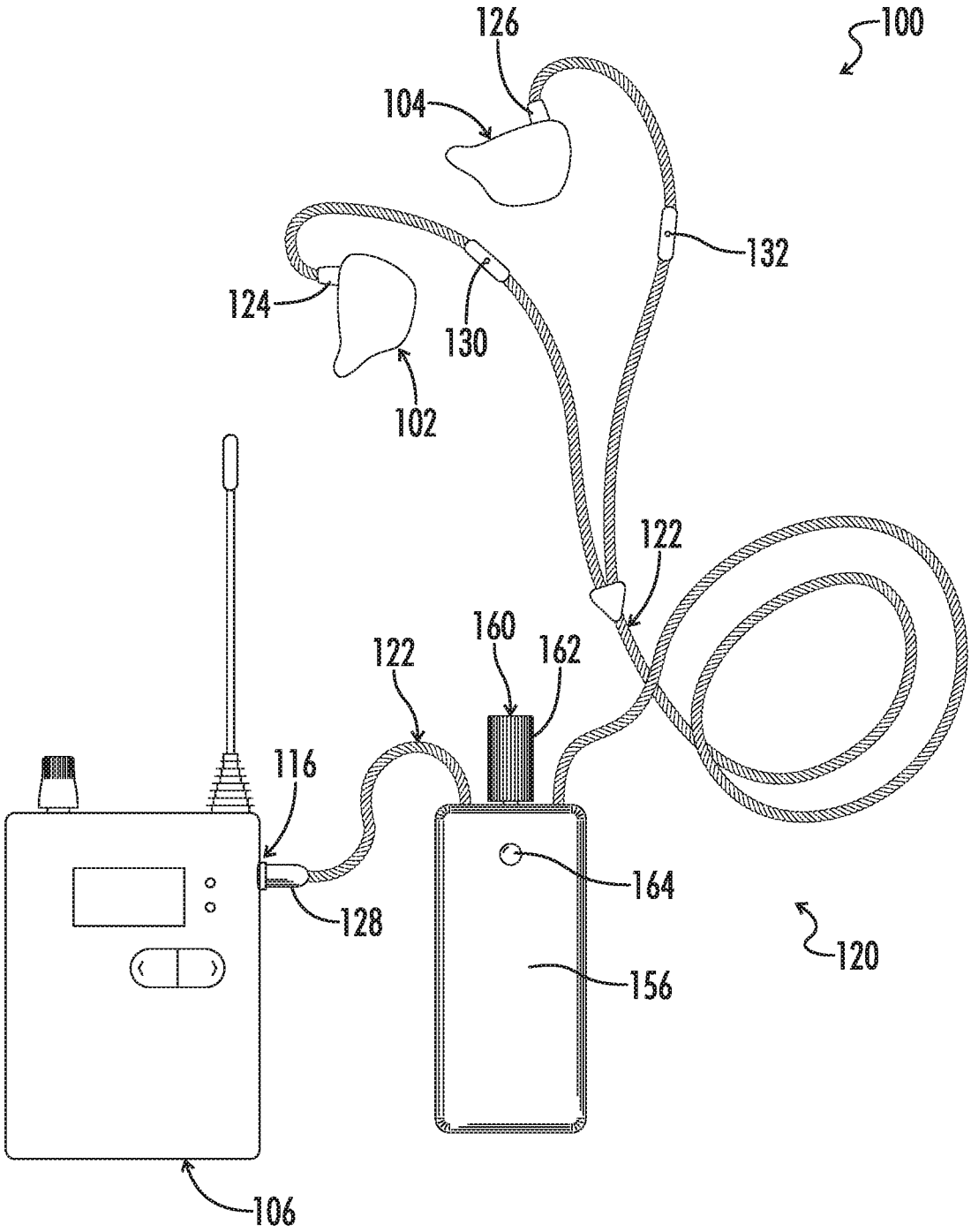
FIG. 2 illustrates a perspective view of an audio monitoring system that includes the exemplary embodiment of the cable apparatus of FIG. 1.
Figure 3:
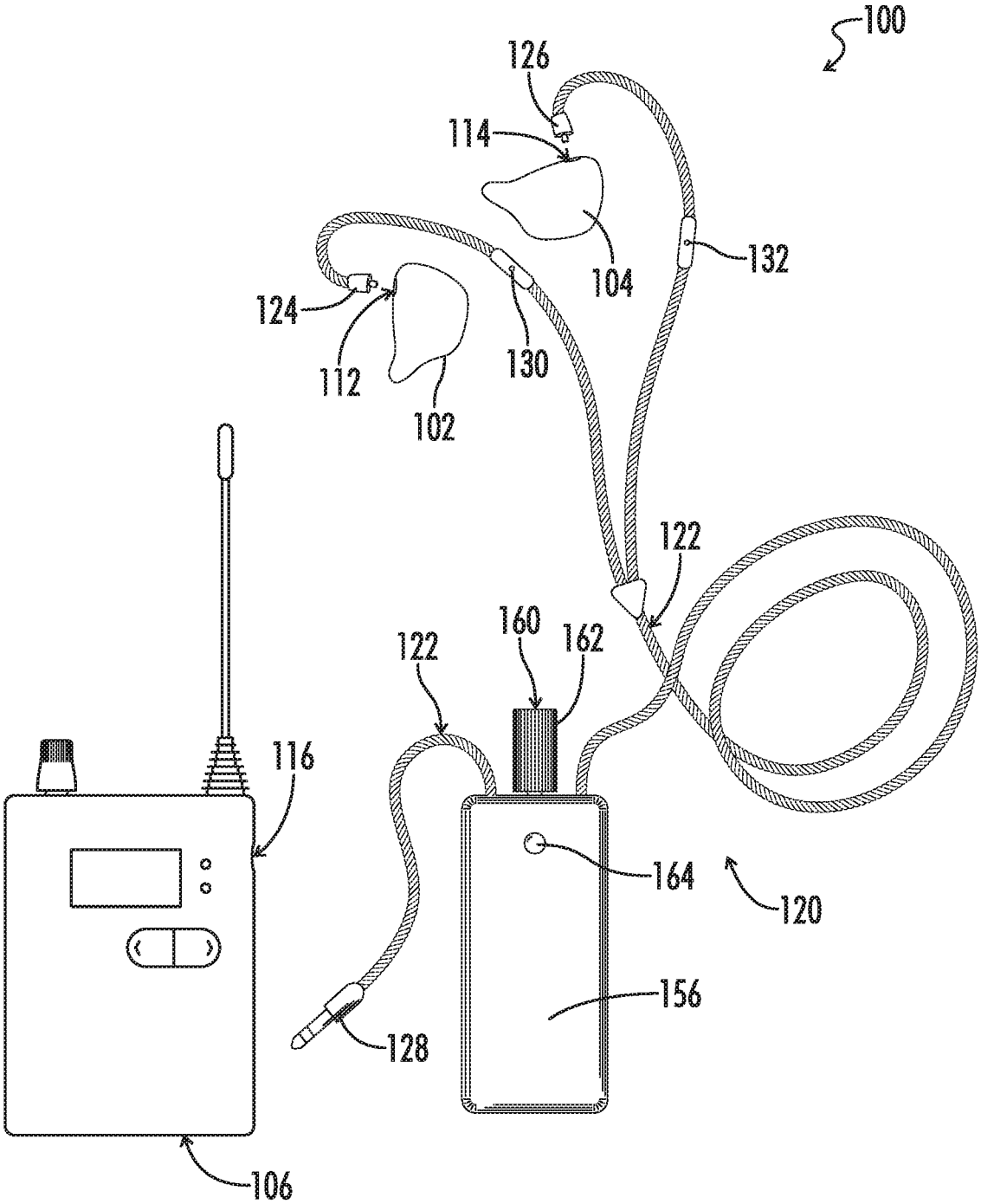
FIG. 3 illustrates an exploded view of the exemplary audio monitoring system of FIG. 2.
Figure 5:
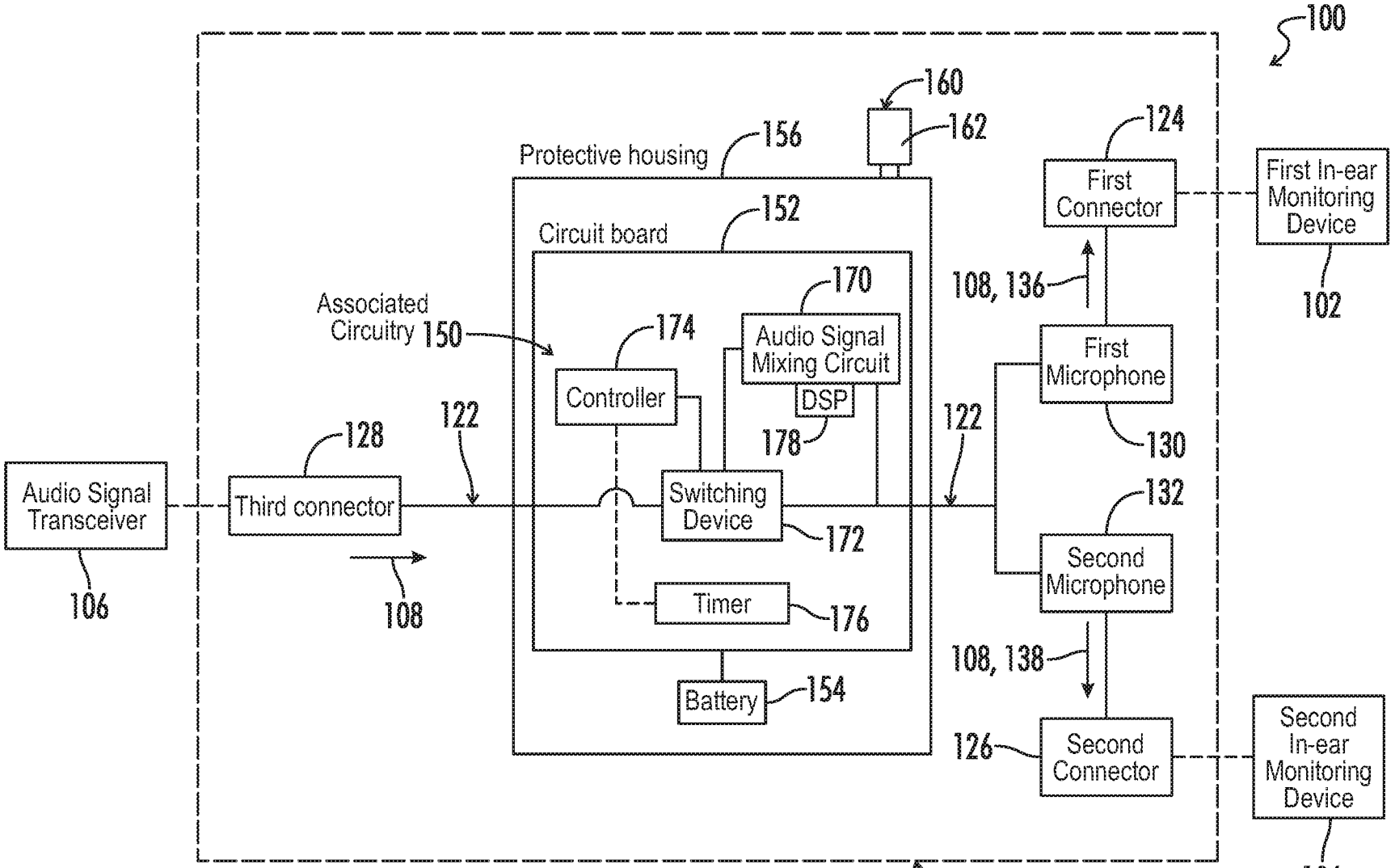
FIG. 5 illustrates a block diagram of the exemplary audio monitoring system of FIG. 2.

As can best be seen in FIGS. 2, 3, and 5, the audio monitoring system 100 includes the cable apparatus 120, a first in-ear monitoring device 102, a second in-ear monitoring device 104, and an audio signal transceiver 106. The first and second in-ear monitoring devices 102, 104 may also be referred to herein as first and second in-ear headphones 102, 104 or first and second audio blocking headphones. The audio signal transceiver 106 may also be referred to herein as an external transceiver 106 or a wireless body pack 106. The first and second in-ear monitoring devices 102, 104 each include a respective audio input port 112, 114. The audio signal transceiver 106 includes an audio output port 116. The cable apparatus 120 may be configured to connect between each respective audio input port 112, 114 of the first and second in-ear monitoring devices 102, 104, respectively. The cable apparatus 120 may further be configured to connect to the audio output port 116 of the audio signal transceiver 106.

The audio signal transceiver 106 is configured to transmit a received monitor mix signal 108 through the cable apparatus 120 to the first and second in-ear monitoring devices 102, 104. The first and second in-ear monitoring devices 102, 104 may substantially block ambient noise so that the received audio signals are essentially the only source of audio when the in-ear monitoring devices are inserted into respective ears of the user. The monitor mix signal 108 may also be referred to herein as a monitor mix 108. Although the audio signal transceiver 106 is illustrated as wireless in nature, one of skill in the art may appreciate that an audio signal transceiver 106 as disclosed may include hardwired audio sources in addition to or as an alternative to wireless.

As can best be seen in FIGS. 1-3 and 5, the cable apparatus 120 includes an electrical communications channel 122 that has at least a first connector 124 and a second connector 126. The first connector 124 may also be referred to herein as a first output connector 124. The second connector 126 may also be referred to herein as a second output connector 126. The first and second connectors 124, 126 may be configured to selectively couple to the first and second in-ear monitoring devices 102, 104, respectively. For example, the first connector 124 may connect to the audio input port 112 of the first in-ear monitoring device 102 and the second connector 126 may connect to the audio input port 114 of the second in-ear monitoring device 104.

In an embodiment, the first and second connectors 124, 126 are universal which means that they can plug into any of the most popular brands of in-ear monitors. The cable apparatus 120 may accordingly be used with conventional or otherwise existing in-ear monitor molds, such that the user only needs to replace the previous cable.

The electrical communications channel 122 of the cable apparatus 120 may further include a third connector 128 positioned opposite the first and second connectors 124, 126. The third connector 128 may also be referred to herein as an input connector 128. The third connector 128 is configured to selectively couple to the audio output port 116 of the audio signal transceiver 106.

The cable apparatus 120 may further include first and second microphones 130, 132 coupled along the electrical communications channel 122. The first and second microphones 130, 132 may also be referred to herein as first and second micro-electrical-mechanical (MEMS) microphones 130, 132. The first and second microphones 130, 132 may be coupled along the electrical communications channel 122 nearer to the first and second connectors 124, 126, respectively, than to the third connector 128. Accordingly, the first and second microphones 130, 132 are positioned near the ears of a user (e.g., one microphone near the left ear, and one microphone near the right ear). The positioning of the first and second microphones allows the user to blend-in as much or as little room ambience back into the monitor mix signal 108 without removing his/her headphones or needing to use crowd-facing microphones. The positioning of the first and second microphones 130, 132 allows for accurate ambient sound reproduction similar to the sounds that would be heard without the first and second in-ear monitoring devices being inserted into a respective ear 12 of a user 10 (FIG. 4).

Figure 4:
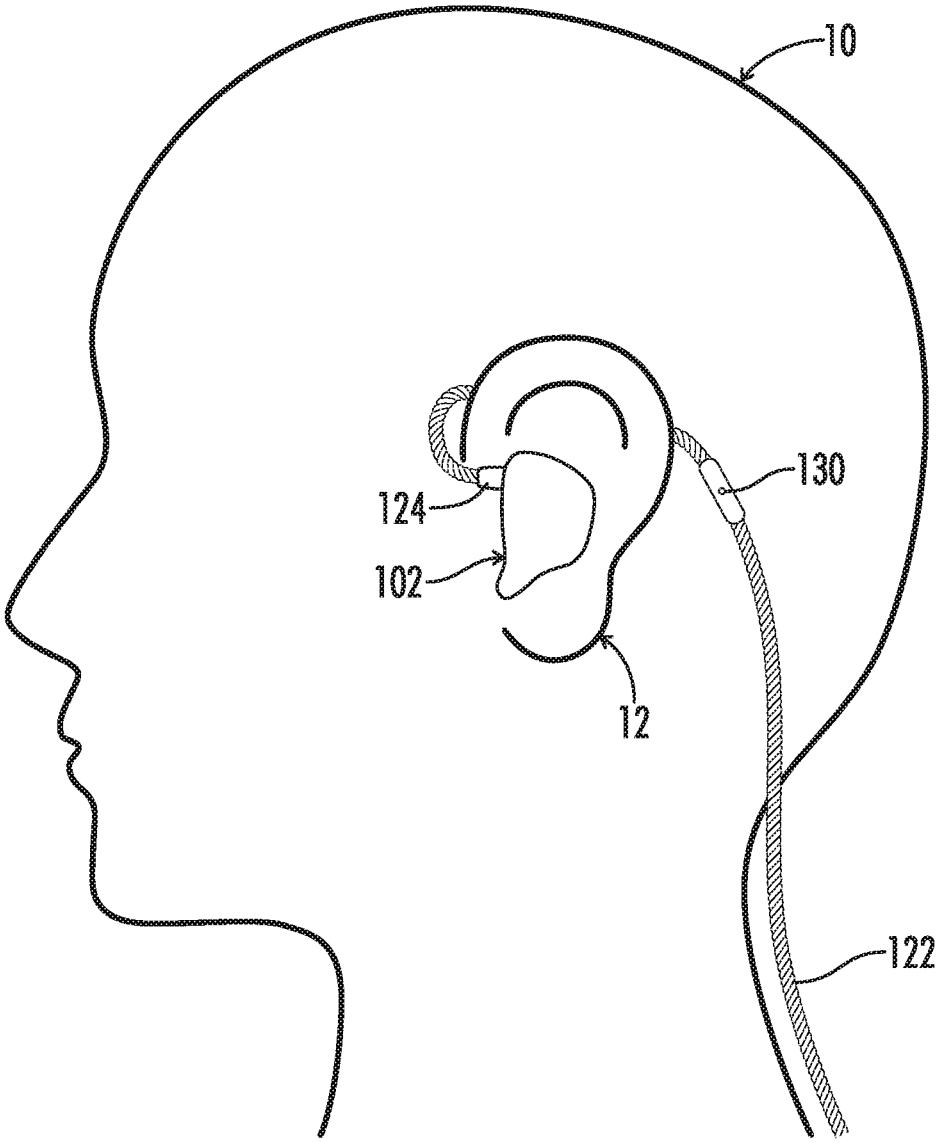
FIG. 4 illustrates a partial view of the exemplary audio monitoring system of FIG. 2, with a microphone of the cable apparatus positioned behind an ear of a user.

As can best be seen in FIG. 4, the first and second microphones 130, 132 are optimally configured to be placed along the electrical communications channel 122 just behind the ears 12 of the user 10. FIG. 4 is illustrative of how musicians wear in-ear monitors and the orientation of the cable going from the ears behind the head. The first and second microphones 130, 132 are offset from the first and second connectors 124, 126, respectively, by an offset distance 134 (FIG. 1). In certain embodiments, the offset distance 134 may be less than or equal to 5 inches.

The first and second microphones 130, 132 are each configured to monitor first and second ambient sound signals 136, 138. The first ambient sound signal 136 may also be referred to herein as a first sound signal 136, a first audio signal 136, or an audio signal 136 associated with the first microphone 130. The second ambient sound signal 138 may also be referred to herein as a second sound signal 138, a second audio signal 138, or an audio signal 138 associated with the second microphone 132. As previously mentioned, the first and second microphones 130, 132 are positioned on opposite sides of the user's head when the first and second connectors 124, 126 are connected to the first and second in-ear monitoring devices 102, 104 received in respective ears 12 of the user 10. Accordingly, the first and second microphones 130, 132 can accurately capture ambient noises to the left and right of the user 10.

Although the term "electrical communications channel" as used herein may refer collectively to elements of a cable apparatus between the first and second in-ear monitoring devices 102, 104 and the audio signal transceiver 106, it may be understood that each microphone may be assigned to a particular "channel" for the purpose of audio signal processing.

As can best be seen in FIG. 5, the cable apparatus may further include a circuit board 152 and associated circuitry 150 for mixing the first and second ambient sound signals 136, 138 with the monitor mix signal 108. The circuit board 152 and the associated circuitry 150 is coupled along the electrical communications channel 122 nearer to the third connector 128 than to the first and second connectors 124, 126.

The cable apparatus 120, and in particular the circuit board 152 and the associated circuitry 150, may be configured to mix the first ambient sound signal 136 with the received monitor mix signal 108 for transmission to the first in-ear monitoring device 102 and to mix the second ambient sound signal 138 with the received monitor mix signal 108 for transmission to the second in-ear monitoring device 104.

When mixing one audio signal with another, there are two exemplary approaches: passive mixing and active mixing. Active mixing requires power to be applied to the circuit, while passive mixing does not. Passive mixing of two signals results in reduced volume of the original signal. Active mixing can be used to overcome that issue when the need to keep signals from dropping in volume is necessary.

For the purpose of maintaining the volume from the audio signal transceiver 106, in an embodiment of a cable apparatus 120, as disclosed herein, the first and second ambient sound signals 136, 138 and monitor mix signal 108 are mixed actively, instead of passively. As a result, the cable apparatus 120 may include a battery 154 for powering the circuit board 152 and the associated circuitry 150. The battery 154 may for example be a Lithium Polymer type battery. The battery 154 may for example be rechargeable through a USB port (not shown) associated with the circuit board 152 of the cable apparatus 120.

The cable apparatus 120 is operable in a first power source input status and a second power source input status. The first power source input status is associated with an availability of power from the battery 154 to the circuit board 152 and the associated circuitry 150. The second power source input status is associated with an unavailability of power from the battery 154 to the circuit board 152 and the associated circuitry 150. The cable apparatus 120 is configured such that the monitor mix signal 108 may be transmitted through the cable apparatus 120 from the audio signal transceiver 106 to the first and second in-ear monitoring devices 102, 104, in both the first and second power source input statuses.

The battery 154, the circuit board 152 and the associated circuitry 150 may be positioned within a protective housing 156. The protective housing may include a belt clip (not shown) so that the protective housing 156 may be clipped to a belt (not shown) of the user 10 proximate to the audio signal transceiver 106.

Typically, when some kind of mixer is added to an audio signal, volume controls are further added for each audio signal. In an embodiment of the cable apparatus 120 as disclosed herein, a microphone adjustment interface 160 is provided for controlling a volume of the first and second ambient sound signals 136, 138 produced by the first and second microphones 130, 132. The monitor mix signal 108 coming from the audio signal transceiver 106 is maintained as per the same volume setting on the audio signal transceiver 106. In this way, the cable apparatus 120 has an output that essentially mimics how the factory-shipped in-ear cable operates—i.e., the user 10 may control the master volume of the monitor mix signal 108 with the volume control associated with the audio signal transceiver 106. The monitor mix signal 108 from the audio signal transceiver 106 may be set in the circuit board 152 and the associated circuitry 150 to "unity gain," or a 1-to-1 ratio in volume.

As can best be seen in FIGS. 1-3, the microphone adjustment interface 160 is digital and is configured to be adjustable at the protective housing 156. The microphone adjustment interface 160 may be coupled to the circuit board 152 and the associated circuitry 150. The microphone adjustment interface 160 is configured for selectively adjusting aspects (e.g., the volume) of the first and second ambient sound signals 136, 138 associated with the first and second microphones 130, 132. The microphone adjustment interface 160 may be an incremental rotary encoder with a push button feature. "Incremental" may mean when a knob 162 of the microphone adjustment interface 160 (e.g., of the incremental rotary encoder) is turned, it "clicks" to the next position instead of smoothly turning clockwise or counter-clockwise. The knob 162 may also function as the push button feature.

Figure 6:
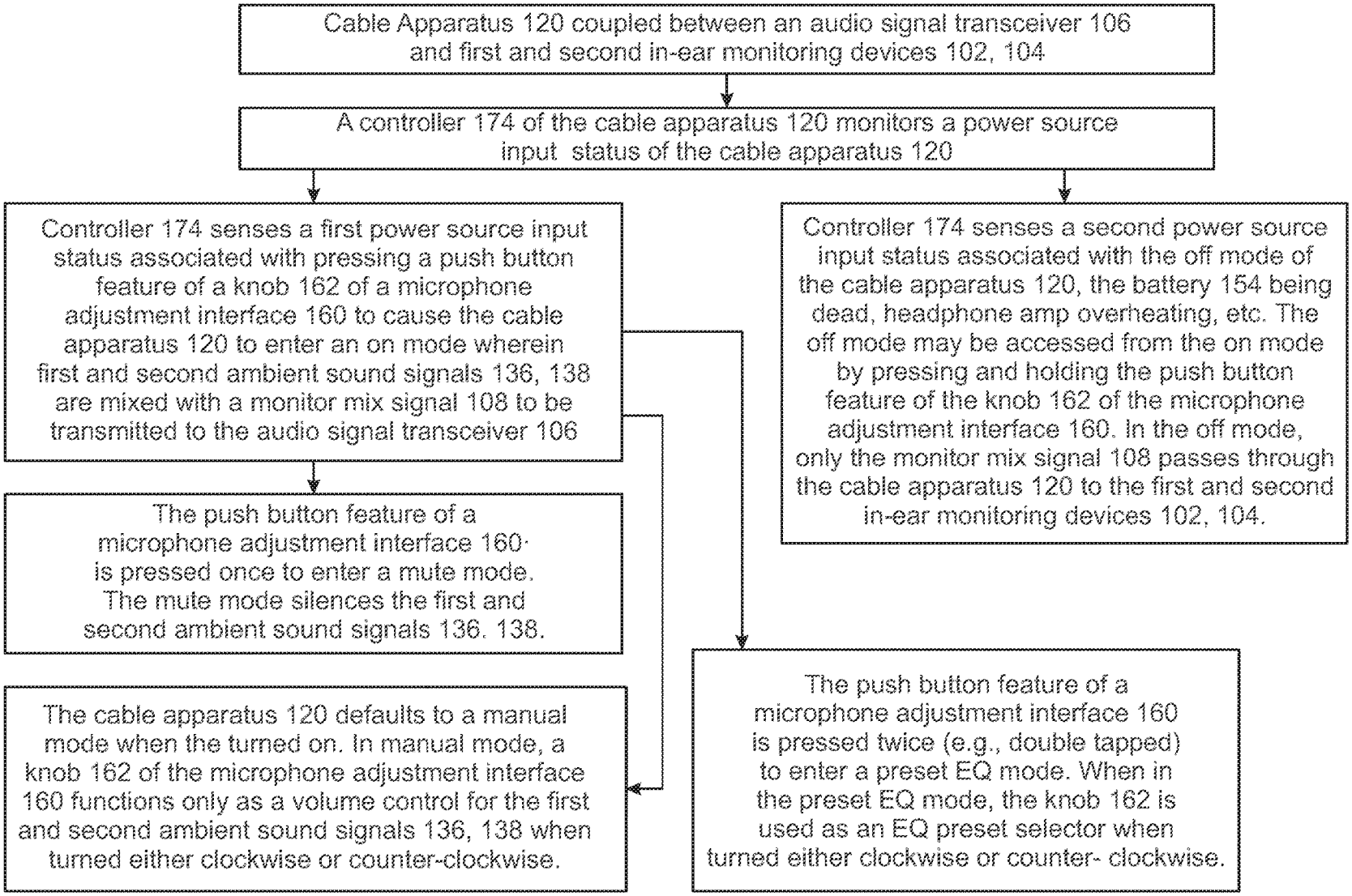
FIG. 6 illustrates a flow chart of an embodiment of a method of controlling an operational mode of the audio monitoring system of FIG. 2 in accordance with the present disclosure.

The knob 162 may serve as a single simplified control for selecting an operational mode (FIG. 6) of the cable apparatus 120. The operational mode may be at least one of an on mode, an off mode, a manual mode, a preset equalizer (EQ) mode, or a mute mode. The push button feature of the knob 162 is activated by pressing the knob 162 down from the top and encoder steps of the knob 162 are activated by turning the knob clockwise or counter-clockwise. When pressed, the push button feature of the knob 162 serves as an on/off switch.

The push button feature of the knob 162 is pressed once to turn the cable apparatus 120 on (i.e., to enter the on mode). The on mode is associated with a first power source input status of the cable apparatus 120. The push button feature of the knob 162 is pressed and held to turn the cable apparatus 120 off (i.e., to enter the off mode). The off mode is associated with a second power source input status of the cable apparatus 120. A light emitting diode (LED) light 164 may be disposed on the protective housing 156 and may be coupled to the circuit board 152 and the associated circuitry 150 for indicating whether the cable apparatus is in the on mode or the off mode (e.g., to indicate a power source input status of the cable apparatus 120).

The manual mode is the default when the cable apparatus 120 enters the on mode. The in manual mode, the knob 162 functions only as a volume control for the first and second ambient sound signals 136, 138 when turned either clockwise or counter-clockwise. The mute mode is accessed (or activated) when the cable apparatus 120 is in the on mode by pressing the push button feature of the knob 162 once. The mute mode silences the first and second ambient sound signals 136, 138. When in the mute mode, the mute mode may be deactivated by pressing the push button feature of the knob 162 once. The preset EQ mode is also accessed when the cable apparatus 120 is in the on mode by pressing the push button feature of the knob 162 twice (e.g., double tapping the knob 162). When in the preset EQ mode, the knob 162 is used as an EQ preset selector when turned either clockwise or counter-clockwise. Finally, when in the present EQ mode, the preset EQ mode may be deactivated by pressing the push button feature of the knob 162 once to thus return the manual mode.

In some embodiments (not shown), the microphone adjustment interface 160 is digital and is configured to be adjustable near each ear 12 of the user 10 where either the first or the second microphone 130, 132 is located. A user interface, such as for example, one or more buttons may be provided for "volume up" and "volume down" selection. In one particular example, the user 10 can selectively mute both microphones by pressing both buttons at once, wherein only the monitor mix signal 108 from the audio signal transceiver 106 is heard. Additionally, the microphone adjustment interface 160 located at each of the first and second microphones 130, 132 may be synced such that pressing the volume control buttons near either ear 12 of the user 10 may further control both volume levels of both the first and second ambient sound signals 136, 138 at once. In other embodiments (not shown), the microphone adjustment interface 160 may comprise one or a plurality of buttons disposed on the protective housing and electrically coupled to the circuit board 152 and the associated circuitry 150.

The associated circuitry 150 of the circuit board 152 of the cable apparatus 120 may include an audio signal mixing circuit 170. The audio signal mixing circuit 170 may also be referred to herein as an active mixing circuit 170. For active mixing, the audio signal mixing circuit 170 will requires power to be provided thereto. The cable apparatus 120 is configured such that when no power is provided to the audio signal mixing circuit 170, neither the monitor mix signal 108 nor the first or second ambient sound signals 136, 138 will pass through the audio signal mixing circuit 170.

An embodiment of a cable assembly as disclosed herein may enable the monitor mix signal 108 to pass through the cable apparatus 120 of the audio monitoring system 100 even when the cable apparatus 120 is in the off mode or a component of the circuit board 152 and the associated circuitry 150 enters a component fault status (e.g., the battery 154 dies, the headphone amp overheats, or the like). The component fault status is associated with the off mode and the second power source input status. This enables the cable apparatus 120 to function like any regular in-ear monitor replacement cable so that even if the battery 154 dies, the headphone amp overheats, or something else goes wrong in the cable apparatus 120, the cable apparatus 120 is still able to transmit the monitor mix signal 108 may from the audio signal transceiver 106 to the first and second in-ear monitoring devices 102, 104. Accordingly, the associated circuitry 150 of the circuit board 152 of the cable apparatus 120 may include a switching device 172. In other words, the switching device 172 of the cable apparatus 120 is configured such that the monitor mix signal 108 always flows from the audio signal transceiver 106 to the first and second in-ear monitoring devices 102, 104.

In one embodiment, the switching device 172 may be a relay. When engaged, the switching device 172 directs the monitor mix signal 108 through the audio signal mixing circuit 170. When disengaged (e.g., either responsive to the cable apparatus 120 being in the off mode, the battery 154 being dead, headphone amp overheating, etc.), the switching device 172 directs the monitor mix signal 108 from the audio signal transceiver 106 to bypass the audio signal mixing circuit 170 and straight to the first and second connectors 124, 126 (e.g., the output) of the cable apparatus 120 at the respective first and second in-ear monitoring devices 102, 104. This is a major part of what makes this cable apparatus 120 unique: it implements a technique known as "true bypass".

Accordingly, a "true bypass" technique as disclosed herein and in association with the aforementioned cable apparatus 120 substantially prevents the circumstance wherein a musician could be performing with the audio monitoring system 100 and the battery 154 of the cable apparatus 120 could die, resulting in no monitor mix signal 108 from the audio signal transceiver 106 being delivered to the first and second in-ear monitoring devices 102, 104. Such a situation could ruin a performance.

In an embodiment, the associated circuitry 150 of the circuit board 152 of the cable apparatus 120 may include a controller 174 configured to regulate operation of the switching device 172 for the true bypass feature. The controller 174 may be configured to determine the power source input status of the cable apparatus 120 to the audio signal mixing circuit 170. The controller 174 may include associated logic for switching the switching device 172 (e.g., relay) on and off (e.g., responsive to determining the battery dying, headphone amp overheating, etc.). For example, the controller 174 may be configured to regulate the switching device 172 responsive to the first power source input status (e.g., associated with the on mode of the cable apparatus 120) to cause mixed audio signals (e.g., the monitor mix signal 108 and the first and second ambient sound signals 136, 138) from the first and second microphones 130, 132 and from the audio signal transceiver 106 to be delivered to the first and second in-ear monitoring devices 102, 104. Additionally, for example, the controller 174 may be configured to regulate the switching device 172 responsive to the second power source input status (e.g., associated with the off mode of the cable apparatus 120, the battery 154 being dead, headphone amp overheating, etc.) to cause only audio signals (e.g., the monitor mix signal only) from the audio signal transceiver 106 to be delivered to the first and second in-ear monitoring devices 102, 104.

In certain embodiments, the microphone adjustment interface 160 may be coupled to one of the audio signal mixing circuit 170 or the controller 174. As illustrated, the microphone adjustment interface 160 is coupled to the audio signal mixing circuit 170.

In an embodiment, a timer 176 may further be provided, e.g. in association with the controller 174, that is configured to monitor an absence of the monitor mix signal 108 coming from the audio signal transceiver 106 when the cable apparatus 120 is in an on mode. If there is no monitor mix signal 108 from the audio signal transceiver 106, then the controller 174 may transition into true bypass mode which causes the switching device 172 to bypass the audio signal mixing circuit 170 (e.g., the audio mixing circuit 170 is turned off), thereby saving power. If the monitor mix signal 108 is subsequently detected within a predetermined time period (e.g., one hour), the controller 174 may automatically power the audio signal mixing circuit 170 back up by engaging the switching device 172 so that the audio signal mixing circuit 170 is now actively mixing the monitor mix signal 108 again with first and second ambient sound signals 136, 138. If no monitor mix signal 108 is detected within the predetermined time period (e.g., one hour), the cable apparatus 120 may be turned completely off (e.g., enter the off mode) and remain in the off mode until the cable apparatus 120 is turned back on. This may be implemented as a power saving feature, wherein for example the user 10 forgets to turn off the cable apparatus 120.

In an embodiment, the audio signal mixing circuit 170 may include a digital signal processor (DSP) 178 for compression/limiting and equalization for the first and second ambient sound signals 136, 138 from the first and second microphones 130, 132 to help protect the user's hearing, as well as cut out unneeded frequencies. The DSP 178 may be implemented for implementing a certain preset EQ when in the cable apparatus 120 is in the preset EQ mode.

In other embodiments (not shown), a compressor may be implemented and for example be set to limit at 110 dB SPL and will not distort up to 132 dB SPL. In certain embodiments (not shown), an equalizer (EQ) may be implemented which includes a high pass filter set at 250 Hz with a 12 dB/octave slope (e.g., this means the only audio frequencies above 250 Hz will pass through the active mixing circuit). The EQ may further include a low pass filter set at 8 kHz with a 12 dB/octave slope (e.g., this means only audio frequencies below 8 kHz will pass through the active mixing circuit). The EQ may still further include a switchable 4 kHz bandpass cut that has a 2 kHz bandwidth with a 6-dB cut (e.g., this means that when it is engaged, some "harshness" in the audio signal will be reduced).

Figure 7:
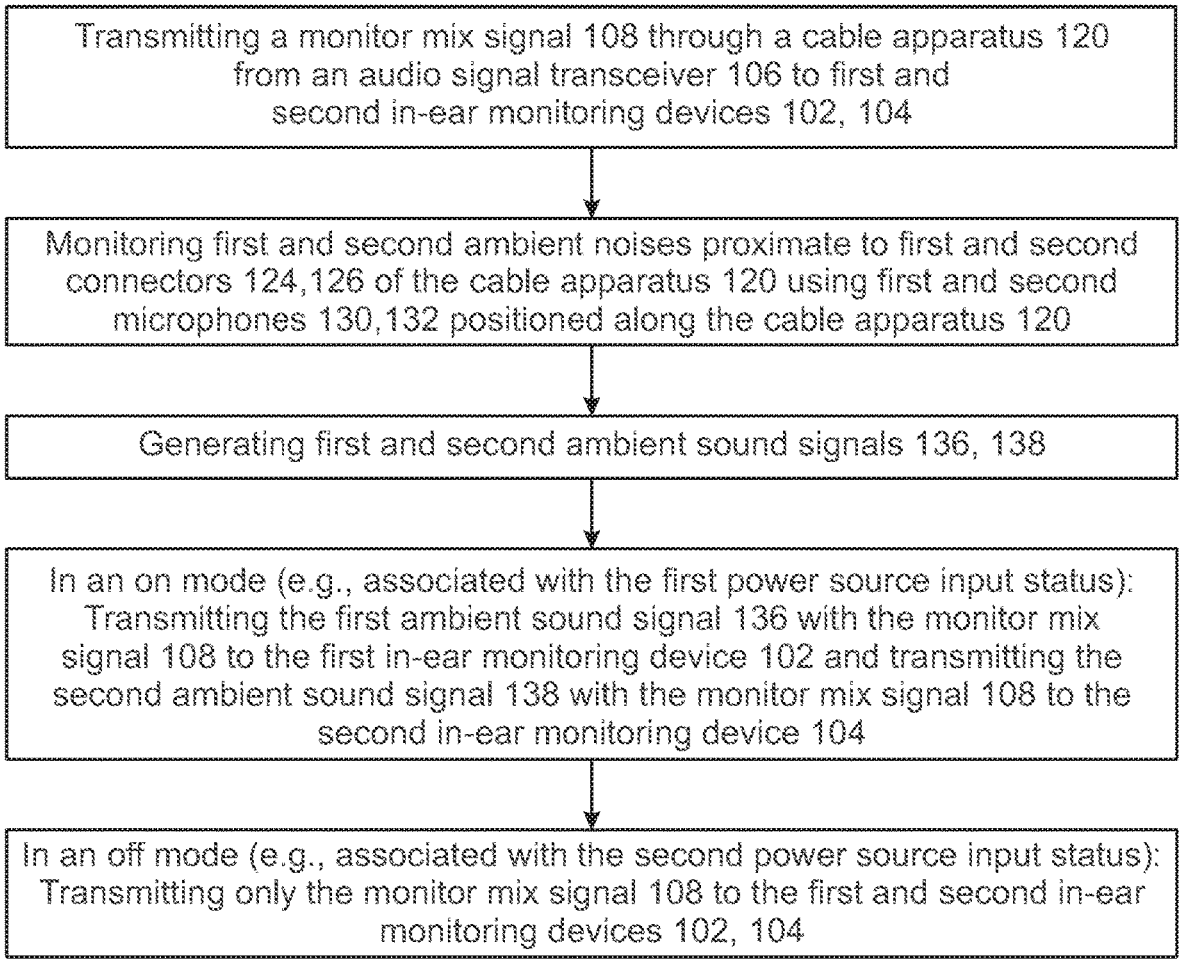
FIG. 7 illustrates a flow chart of an embodiment of a method of mixing ambient sound signals with monitor mix signals of the audio monitoring system of FIG. 2 in accordance with the present disclosure.

Referring to FIG. 7, a method of adding ambient noise to a monitor mix is provided. The method may include transmitting the monitor mix signal 108 through the cable apparatus 120 from the audio signal transceiver 106 to the first and second in-ear monitoring devices 102, 104. The method may further include monitoring first and second ambient noises proximate to the first and second connectors 124, 126 and generating the first and second ambient sound signals 136, 138. The method may further include transmitting the first ambient sound signal 136 with the monitor mix signal 108 to the first in-ear monitoring device 102 and transmitting the second ambient sound signal 138 with the monitor mix signal 108 to the second in-ear monitoring device 104, when in the on mode. Alternatively, the method may further include transmitting only the monitor mix signal 108 to the first and second in-ear monitoring devices 102, 104, when in the off mode.

In certain embodiments, the method may also include controlling at least one aspect of the first and second ambient sound signals 136, 138 without affecting the monitor mix signal 108.

The method may include multiple other steps corresponding to the above disclosures.

Although the audio mixing circuit 170, the switching device 172, the controller 174, the timer 176, and the DPS 178 are described as being part of the circuit board 152 and the associated circuitry 150, the individual aforementioned elements may be separate, not all connected to the circuit board 152, or a combination thereof may be connected to the circuit board 152.

Throughout this description and the following claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct physical connection between the connected items or an indirect connection, for example wirelessly or through one or more passive or active intermediary devices.

Terms such as "wire," "wiring," "line," "signal," "conductor," and "bus" may be used to refer to any known structure, construction, arrangement, technique, method and/or process for physically transferring a signal from one point in a circuit to another.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general-purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A cable apparatus for connecting an audio signal transceiver to first and second in-ear monitoring devices, the system comprising:

an electrical communications channel having first and second connectors configured for selective coupling to the first and second in-ear monitoring devices, respectively;

first and second microphones coupled along the electrical communications channel;

an audio signal mixing circuit coupled along the electrical communications channel and including a switching device; and a controller configured to determine a power source input status to the audio signal mixing circuit, to regulate the switching device responsive to a first power source input status to cause mixed audio signals from the first and second microphones and from the audio signal transceiver to be delivered to the first and second in-ear monitoring devices, and to regulate the switching device responsive to a second power source input status to cause only audio signals from the audio signal transceiver to be delivered to the first and second in-ear monitoring devices.

2. The cable apparatus of claim 1, wherein the electrical communications channel includes a third connector for selectively coupling to the audio signal transceiver.

3. The cable apparatus of claim 2, wherein:

the third connector is positioned opposite of the first and second connectors; and the audio signal mixing circuit and the controller are positioned nearer to the third connector than to the first and second connectors.

4. The cable apparatus of claim 2, wherein:

the third connector is positioned opposite of the first and second connectors; and the first and second microphones are coupled nearer to the first and second connectors, respectively, than to the third connector.

5. The cable apparatus of claim 1, wherein the first and second microphones are offset from the first and second connectors, respectively, by an offset distance, the offset distance being less than or equal to 5 inches.

6. The cable apparatus of claim 1, wherein the electrical communications channel is hard-wired to the audio signal transceiver.

7. The cable apparatus of claim 1, further comprising a microphone adjustment interface coupled to the audio signal mixing circuit, the microphone adjustment interface configured for selectively adjusting the audio signals associated with the first and second microphones.

8. The cable apparatus of claim 7, wherein:

the microphone adjustment interface is also configured for selecting an operational mode of the cable apparatus; and the operational mode is at least one of an on mode, an off mode, a manual mode, a preset EQ mode, or a mute mode.

9. The cable apparatus of claim 1, further comprising a battery for at least powering the audio signal mixing circuit to enable active mixing of the audio signals of the audio signal transceiver and the first and second microphones by the audio signal mixing circuit.

10. The cable apparatus of claim 1, wherein:

the first power source input status is associated with power availability from a battery connected to the audio mixing circuit; and the second power source input status is associated with power unavailability from the battery to the audio mixing circuit.

11. The cable apparatus of claim 1, wherein the second power source input status is associated with a component fault status such as an amp of the audio mixing circuit overheating.

12. The cable apparatus of claim 1, wherein the audio signal mixing circuit includes a digital signal processor for limiting and equalizing audio signals associated with the first and second microphones.

13. The cable apparatus of claim 1, further comprising a timer coupled to the controller, the timer responsive to an absence of the audio signal from the transceiver for a predetermined time period to cause the controller to switch from the first power source input status to the second power input status.

14. An audio monitoring system comprising:

an audio signal transceiver;

first and second in-ear monitoring devices, each of the first and second in-ear monitoring devices having a respective audio input port; and a cable device for transmitting a monitor mix signal from the audio signal transceiver to the first and second in-ear monitoring devices, the cable device including:

first and second output connectors configured to couple to the respective audio input ports of the first and second in-ear monitoring devices;

first and second microphones coupled proximate to the first and second output connectors, respectively;

an audio signal mixing circuit configured to add first and second ambient sound signals of the first and second microphones, respectively, to the monitor mix signal for transmission to the first and second in-ear monitoring devices, respectively; and a controller configured to determine a power source input status to the audio signal mixing circuit, the power source input status being one of a first power source input status or a second power source input status;

the controller being responsive to the first power source input status to cause mixed audio signals from the first and second microphones and from the audio signal transceiver to be delivered to the first and second in-ear monitoring devices; and the controller being responsive to the second power source input status to cause only audio signals from the audio signal transceiver to be delivered to the first and second in-ear monitoring devices.

15. The audio monitoring system of claim 14, wherein:

the audio signal transceiver includes an audio output port; and the cable device includes an input connector configured to couple to the audio output port of the audio signal transceiver.

16. The audio monitoring system of claim 15, wherein the first and second microphones are coupled nearer to the respective first and second output connectors than to the input connector.

17. The audio monitoring system of claim 14, wherein the audio signal transceiver is wireless.

18. The audio monitoring system of claim 14, wherein the cable device includes at least a battery for providing power to at least the controller.

19. A method of adding ambient noise to a monitor mix, the method comprising:

transmitting a monitor mix signal through an audio monitoring cable device from an audio signal transceiver to first and second in-ear headphones;

monitoring first and second ambient noises proximate to first and second connectors of the audio monitoring cable device using first and second microphones of the audio monitoring cable device, respectively, for generating first and second ambient noise signals;

determining a power source input status;

responsive to a first power source input status, causing mixed audio signals from the first and second microphones and from the audio signal transceiver to be delivered to the first and second in-ear monitoring devices; and to regulate the switching device responsive to a second power source input status to cause only audio signals from the audio signal transceiver to be delivered to the first and second in-ear monitoring devices.

20. The method of claim 19, wherein:

the first power source input status is associated with power availability from a battery connected to the audio mixing circuit; and the second power source input status is associated with power unavailability from the battery to the audio mixing circuit.

* * * * *